US007357615B2

(12) United States Patent
Rudd et al.

(10) Patent No.: US 7,357,615 B2
(45) Date of Patent: Apr. 15, 2008

(54) APPARATUS AND METHOD FOR SEAMING A METAL END ONTO A COMPOSITE CAN

(75) Inventors: Michael Rudd, Warrington (GB); Véronique Sins, Grimbergen (BE)

(73) Assignee: Sonoco Development, Inc., Hartsville, SC (US)

( * ) Notice: Subject to any disclaimer, the term of this patent is extended or adjusted under 35 U.S.C. 154(b) by 20 days.

(21) Appl. No.: 11/407,989

(22) Filed: Apr. 20, 2006

(65) Prior Publication Data

US 2007/0248437 A1 Oct. 25, 2007

(51) Int. Cl.
*B21D 51/30* (2006.01)

(52) U.S. Cl. ..... 413/27; 413/6; 413/31

(58) Field of Classification Search ..... 413/4, 413/6, 27–44, 46; 53/281, 334, 338, 485, 53/486, 488, 88, 101
See application file for complete search history.

(56) References Cited

U.S. PATENT DOCUMENTS

| | | | | |
|---|---|---|---|---|
| 2,227,190 | A | | 12/1940 | Kronquest |
| 2,363,248 | A | | 11/1944 | Hopkins |
| 2,433,057 | A | | 12/1947 | Mero |
| 2,506,363 | A | | 5/1950 | Hohl et al. |
| 2,510,457 | A | | 6/1950 | Bjering |
| 2,519,353 | A | | 8/1950 | Cassady |
| 2,578,815 | A | | 12/1951 | Kronquest |
| 2,610,779 | A | | 9/1952 | Fouse |
| 2,620,111 | A | | 12/1952 | Hohl et al. |
| 2,620,112 | A | | 12/1952 | Hohl et al. |
| 2,630,957 | A | | 3/1953 | Hohl et al. |
| 3,236,023 | A | | 2/1966 | Mencacci |
| 4,154,044 | A | * | 5/1979 | Lang ..... 53/97 |
| 4,221,102 | A | * | 9/1980 | Lang et al. ..... 53/96 |
| 5,054,260 | A | * | 10/1991 | Herzog ..... 53/307 |
| 5,214,988 | A | * | 6/1993 | Quigley ..... 82/48 |
| 5,341,620 | A | * | 8/1994 | Katou et al. ..... 53/287 |
| 5,351,864 | A | * | 10/1994 | Semenenko et al. ..... 222/504 |
| 5,782,599 | A | | 7/1998 | Moran et al. |

(Continued)

FOREIGN PATENT DOCUMENTS

DE 11 03 274 3/1961

(Continued)

OTHER PUBLICATIONS

English Translation of FR2698338 A1.*

(Continued)

*Primary Examiner*—Dmitry Suhol
(74) *Attorney, Agent, or Firm*—Alston & Bird LLP

(57) ABSTRACT

A seaming apparatus and method wherein a composite container with a metal end loosely placed thereon is supported on a lifting plate in a vacuum chamber, air is evacuated from the chamber, the lifting plate is raised to engage the metal end with a magnetic seaming chuck, the lifting plate is then lowered to lower the container (optionally aided by one or more magnets in the lifting plate) so as to produce a gap between the metal end and the container, an inert gas is introduced into the chamber, the lifting plate is then raised to engage the container with the metal end, and the metal end is seamed onto the container.

9 Claims, 23 Drawing Sheets

U.S. PATENT DOCUMENTS

| | | | | |
|---|---|---|---|---|
| 5,860,782 | A | 1/1999 | Campbell | |
| 6,105,341 | A * | 8/2000 | Campbell | 53/432 |
| 6,658,824 | B2 * | 12/2003 | Nussbaumer et al. | 53/505 |
| 2004/0197164 | A1 | 10/2004 | Carrein et al. | |

FOREIGN PATENT DOCUMENTS

| | | | |
|---|---|---|---|
| DE | 2317517 | A * | 10/1974 |
| FR | 2 698 338 | | 5/1994 |
| GB | 430 420 | | 6/1935 |
| WO | WO 93/15957 | | 8/1993 |

OTHER PUBLICATIONS

Copy of the European Search Report for European Application No. 07251669.3; Filed Apr. 20, 2007; Date of Completion Jul. 26, 2007.

* cited by examiner

APPARATUS AND METHOD FOR SEAMING A METAL END ONTO A COMPOSITE CAN

BACKGROUND OF THE INVENTION

The invention relates to composite cans formed of paperboard with polymer film and/or metal foil materials, and specifically to a machine and method for seaming a disc-shaped metal closure (referred to herein as a "metal end") onto the top end of a composite can.

Cans are commonly sealed closed with a metal end that is affixed to the can by a seaming operation. When packaging products that are adversely affected by exposure to air, it is frequently desired to evacuate the inside of the can to remove air, and then to introduce an inert gas such as nitrogen into the can while concurrently seaming the metal end onto the can. The seaming operation entails rolling a curled edge of the metal end and a curled flange of the can together to form a "double seam". The seaming machine employs a seaming chuck and a pair of seaming rollers to effect this rolling and seaming operation. The can with the metal end thereon is held against the chuck and the seaming rollers roll the curled edge of the metal end and the flange to form the double seam.

A rotary turret type of seaming machine typically is used for seaming metal ends onto metal cans. The machine has a rotary turntable that supports a plurality of chambers spaced about its circumference. Each chamber essentially comprises a cylindrical tube into which a metal can with a metal end crimped thereon is loaded. The chamber's bottom comprises a lifting plate. A seaming chuck is mounted above each of the chambers. The lifting plates are vertically movable relative to the seaming chucks. A cam is mounted beneath the turntable and engages lifters attached to the lifting plates. As the turntable is rotated about its axis, the lifter for a given chamber is moved vertically according to the cam profile to cause the lifting plate to rise and fall, thereby lifting and lowering the can, in order to perform the various operations involved in the seaming process.

Specifically, the turntable has four 90-degree sectors denoted as A, B, C, and D. In each sector, a particular operation is carried out. A metal end is crimped onto the top of the metal can prior to loading the can into the chamber. During sector A the can is loaded onto the lifting plate and the chamber closes. During sector B a vacuum is drawn inside the chamber. The metal end includes stand-off dimples or the like to provide a gap between the metal end and the can to allow gas transfer out of the can. An inert gas is introduced into the chamber as the turntable continues to rotate through sector C. The inert gas flows into the can through the gap provided by the stand-off dimples. During the last sector D the can is raised and the final seaming is carried out, followed by discharge of the can onto a conveyor.

When this type of machine is used to attempt to seam metal ends onto composite cans, a difficulty is encountered. A metal can has sufficient strength to resist the pressure differential that is created between the inside and the outside of the can when the inert gas is introduced at relatively high pressure into the previously evacuated chamber. In contrast, with a composite can, such a pressure differential can cause the can to implode.

The invention is aimed at solving this implosion problem.

BRIEF SUMMARY OF THE INVENTION

The present invention addresses the above problem and achieves other advantages by providing a seaming apparatus and method wherein a composite container with a metal end loosely placed thereon is supported on a lifting plate in a vacuum chamber, air is evacuated from the chamber, the lifting plate is raised to engage the metal end with a magnetic seaming chuck, the lifting plate is then lowered to lower the container (optionally aided by one or more magnets in the lifting plate) so as to produce a gap between the metal end and the container, an inert gas is introduced into the chamber, the lifting plate is then raised to engage the container with the metal end, and the metal end is seamed onto the container.

A seaming machine in accordance with one embodiment of the invention comprises a rotary turntable that supports a plurality of chambers spaced about its circumference. Each chamber essentially comprises a cylindrical tube into which a metal can with a metal end loosely placed thereon (i.e., not crimped onto the can) is loaded. Each chamber's bottom comprises a lifting plate. A seaming chuck having one or more magnets is mounted above each of the chambers. The lifting plates are vertically movable relative to the seaming chucks. A cam is mounted beneath the turntable and engages lifters attached to each lifting plate. As the turntable is rotated about its axis, the lifter for a given chamber is moved vertically according to the cam profile to cause the lifting plate to rise and fall, thereby lifting and lowering the can, in order to perform the various operations involved in the seaming process.

The turntable in one embodiment has four sectors denoted as A, B, C, and D. In each sector, a particular operation is carried out. During sector A the composite can is loaded onto the lifting plate and the chamber closes. In sector B air is evacuated from the chamber. The cam in this sector has a profile to give sufficient lift to the lifting plate so as to lift the can to bring the metal end into contact with the seaming chuck. The evacuation can occur before, concurrently with, or after the lifting step. The seaming chuck includes magnets to grip the metal end so that when the can is subsequently lowered, the metal end does not fall along with the can but instead is retained on the magnetic seaming chuck.

In sector C the cam lowers the lifting plate at the start of the sector. The lifting plate can include one or more magnets to grip a metal end on the bottom of the can so that the can is lowered along with the magnetic lifting plate. In this manner, a gap is created between the curled flange of the can and the metal end to allow gas transfer. An inert gas is introduced into the chamber as the turntable continues to rotate. Finally, in sector D the composite can is raised and the metal end is seamed onto the can, followed by discharge of the can onto a conveyor.

The cam can be either a custom-made cam having the necessary profile in sector B to lift the can up to engage the metal end with the magnetic seaming chuck, or can comprise a base cam (e.g., configured to seam metal cans that do not require the extra lift) to which an extra-height cam section is attached in sector B.

Thus, the magnetic seaming chuck ensures that the metal end stays in the upper position as the can is lowered when the lifting plate falls, so that the gap for gas transfer is created between the metal end and the composite can. Accordingly, implosion of the composite can is prevented.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Figure 1:
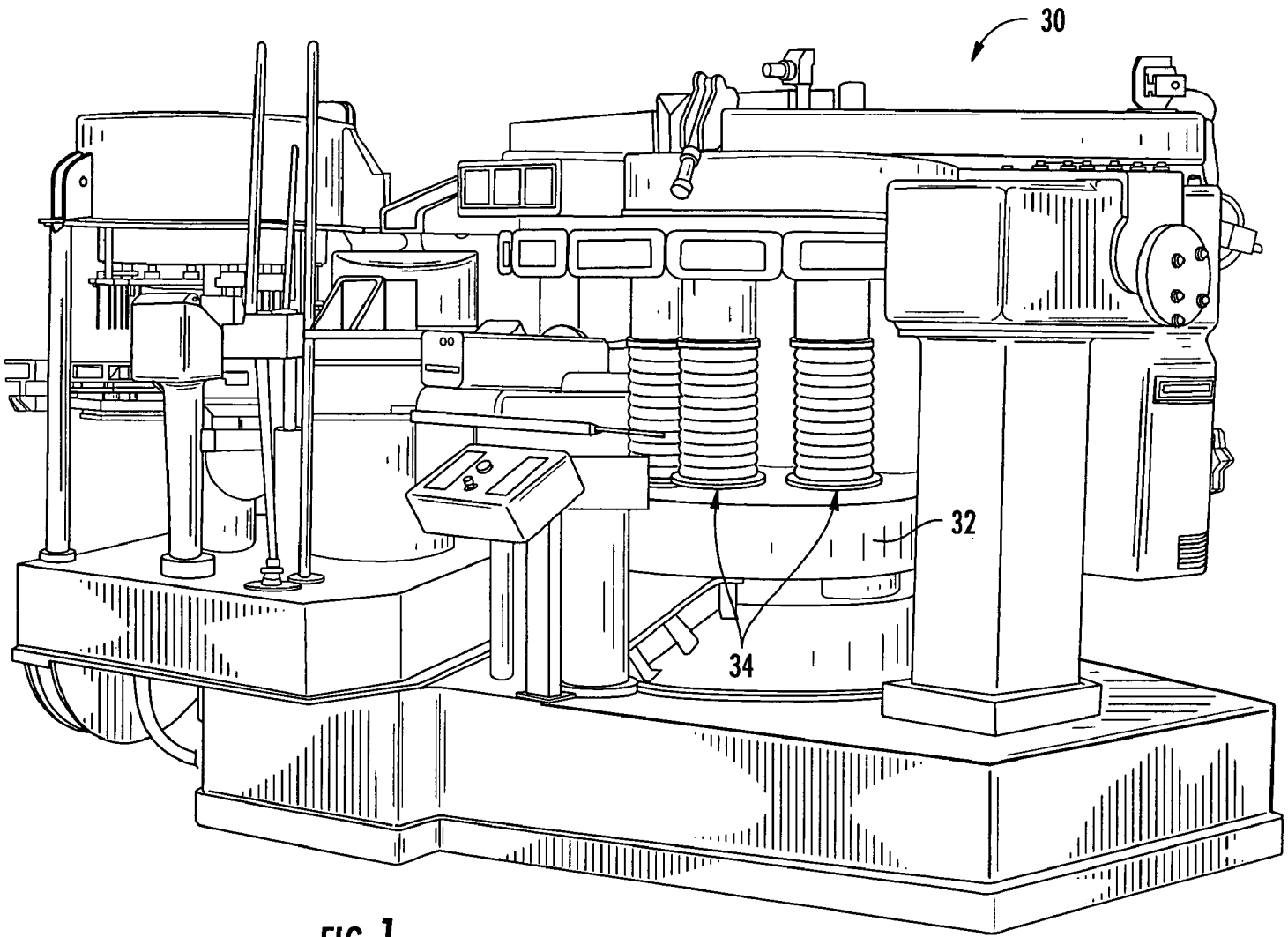
FIG. 1 is an isometric view of a seaming machine in accordance with one embodiment of the present invention.

The present inventions now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

A seaming machine 30 in accordance with one embodiment of the invention is shown in FIGS. 1-3, and FIGS. 4-21 are various views of portions of the machine at different moments in time during a seaming operation on a composite can. The seaming machine 30 is a rotary type of machine having a rotating turntable 32 that supports a plurality of circumferentially spaced vacuum chambers 34 each configured to hold a composite can to be sealed closed. Each chamber 34 has an upper portion 36 comprising a hollow metal member of generally cylindrical configuration, and a lower portion 38 comprising a bellows or the like that is vertically extendable and retractable and that surrounds a composite can placed onto a lifting plate of the chamber, as further described below. In its extended position, the lower portion 38 sealingly engages the upper portion 36 to enclose the composite can in the chamber, as shown for the chambers 34 on the right-hand side of FIG. 3. In its retracted position, the lower portion 38 is disengaged from the upper portion 36 and is lowered sufficiently to allow a composite can to be advanced laterally onto or off of the lifting plate of the chamber, as shown for the second chamber 34 from the left in FIG. 3.

Figure 2:
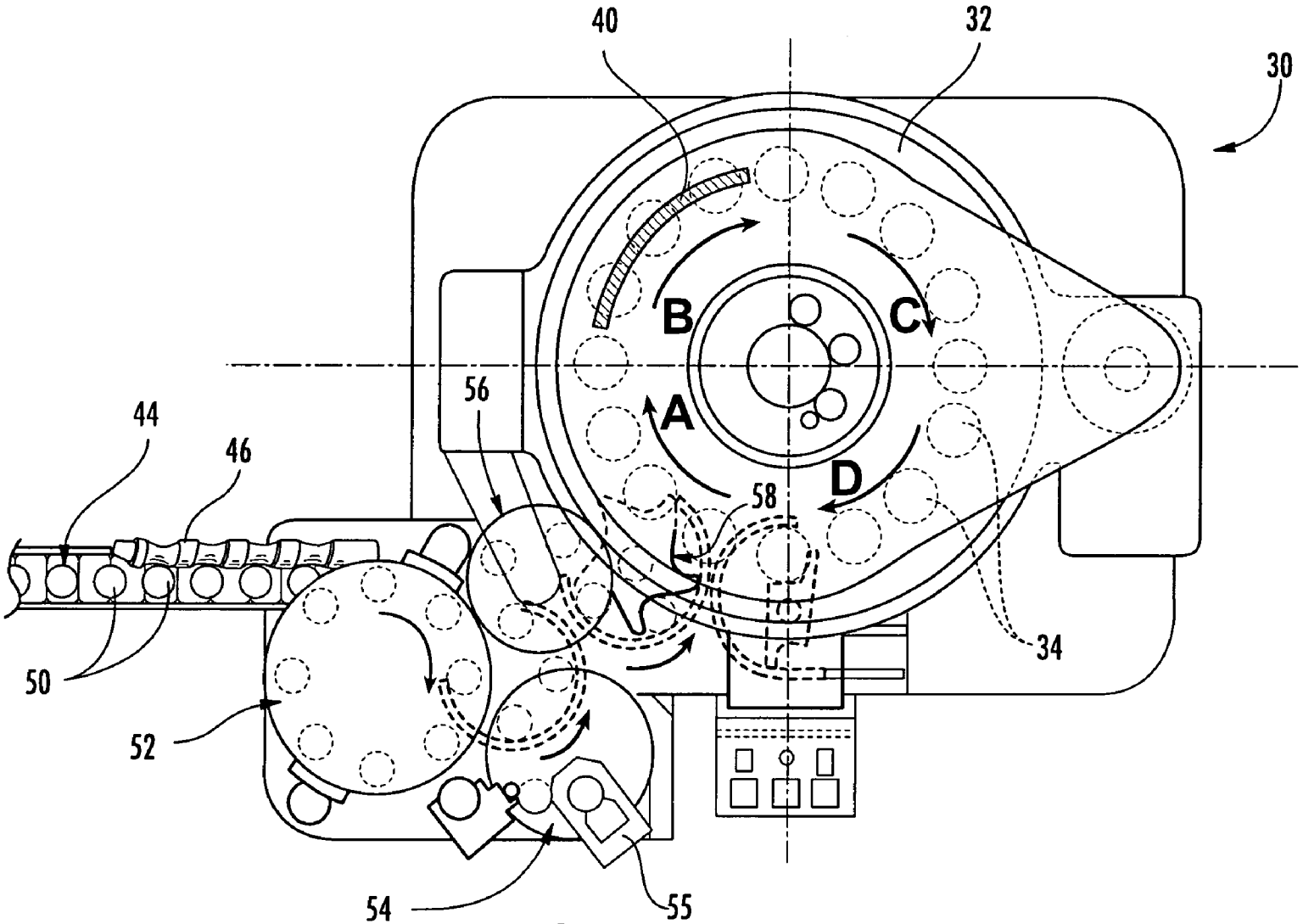
FIG. 2 is a schematic top view of the seaming machine, illustrating the four sectors that make up a complete seaming operation.
Figure 3:
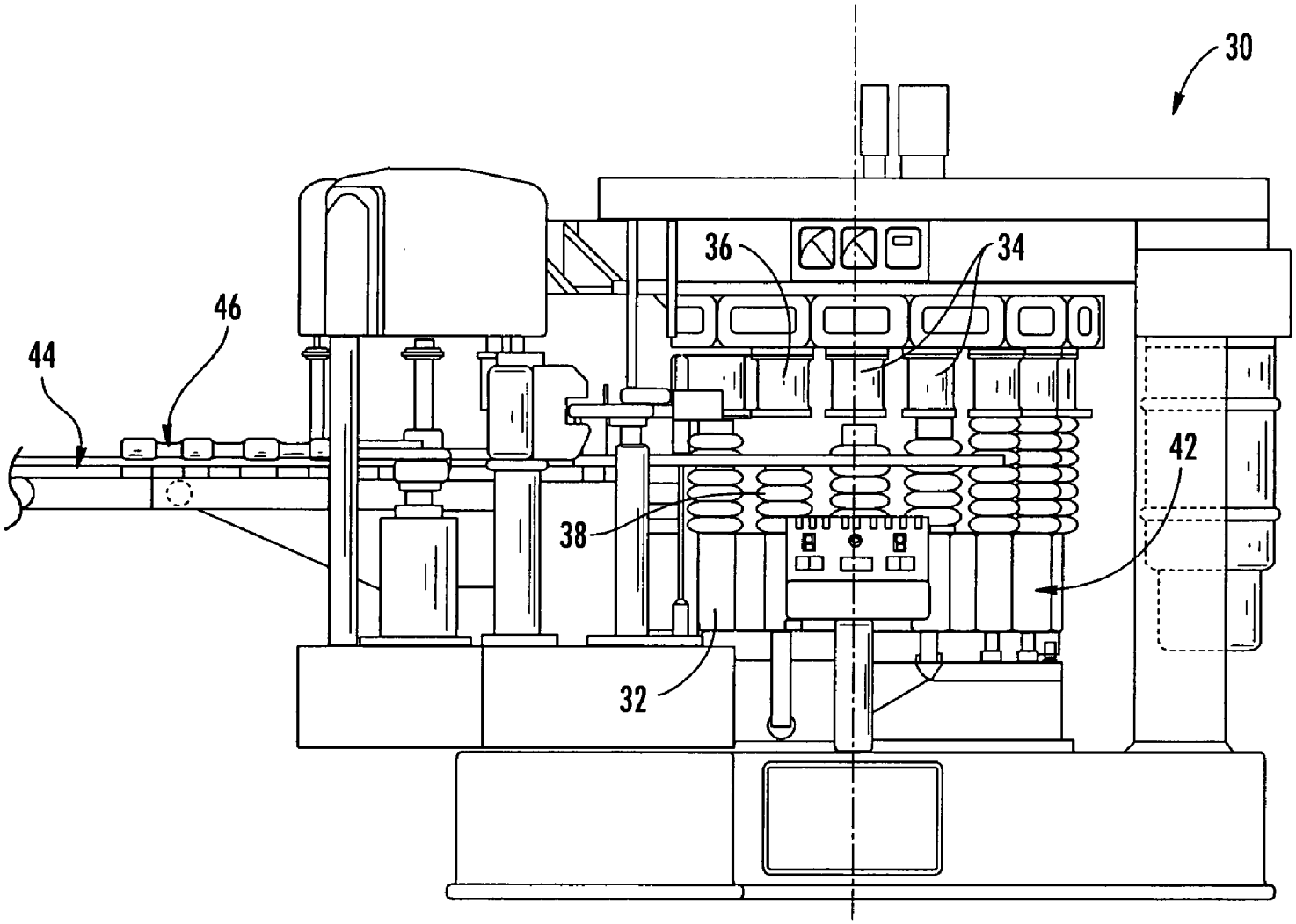
FIG. 3 is a side elevation of the seaming machine.

The machine includes a cam, a portion 40 of which is shown diagrammatically in FIG. 2. The cam is located beneath the turntable 32, and is in the general form of a ring concentric with the turntable and extending beneath the circular path along which the chambers 34 are advanced as the turntable is rotated about its axis. The machine includes a plurality of lifters, shown generally at 42 in FIG. 3, there being one lifter associated with each chamber 34. The lifters are connected to the lifting plates (described below) of the chambers and are engaged by the cam such that as the turntable is rotated about its axis, the profile of the cam causes each lifter to rise and fall in accordance with the cam profile, thereby raising and lowering the lifting plate connected with the lifter.

As schematically depicted in FIG. 2, the seaming machine is divided into four angular sectors A, B, C, and D each occupying approximately 90 degrees of arc. As the turntable 32 is rotated about its axis, a given chamber 34 is carried first through sector A, then through sector B, then through sector C, and finally through sector D. In each sector, various operations are carried out on a composite can disposed in the chamber, as dictated in part by the cam profile governing the movement of the chamber's lifting plate.

The machine is coupled with an infeed conveyor 44 for conveying a series of composite cans 50 to the machine. The infeed conveyor can comprise a feed screw 46 or any other suitable type of mechanism for conveying the cans to the machine. The feed screw 46 feeds the cans to a pocketed turret device 52. Where the product in the cans 50 is a powdered product, the turret device 52 can include a mechanism (not shown) to produce holes in the product to assist with the vacuum of air from the bottom of the can; for a solid product, such a mechanism is not required. The turret device 52 feeds the cans to a pocketed turret 54 that is associated with a metal end feed magazine 55 for feeding metal ends and depositing a metal end into each pocket of the turret 54.

The cans are fed from the turret 54 to a further turret 56, which ordinarily would be used for metal cans to crimp the metal ends onto the cans, but which functions only as a transfer device when the machine is used for composite cans. During the travel from turret 54 to turret 56, the metal ends are placed onto the tops of the composite cans, and the metal ends remain loosely placed atop the cans. Next, the cans are fed from the turret 56 to a transfer turret 58. The transfer turret 58 advances the composite cans 50 one at a time into the chambers 34 of the seaming machine.

Figure 4:
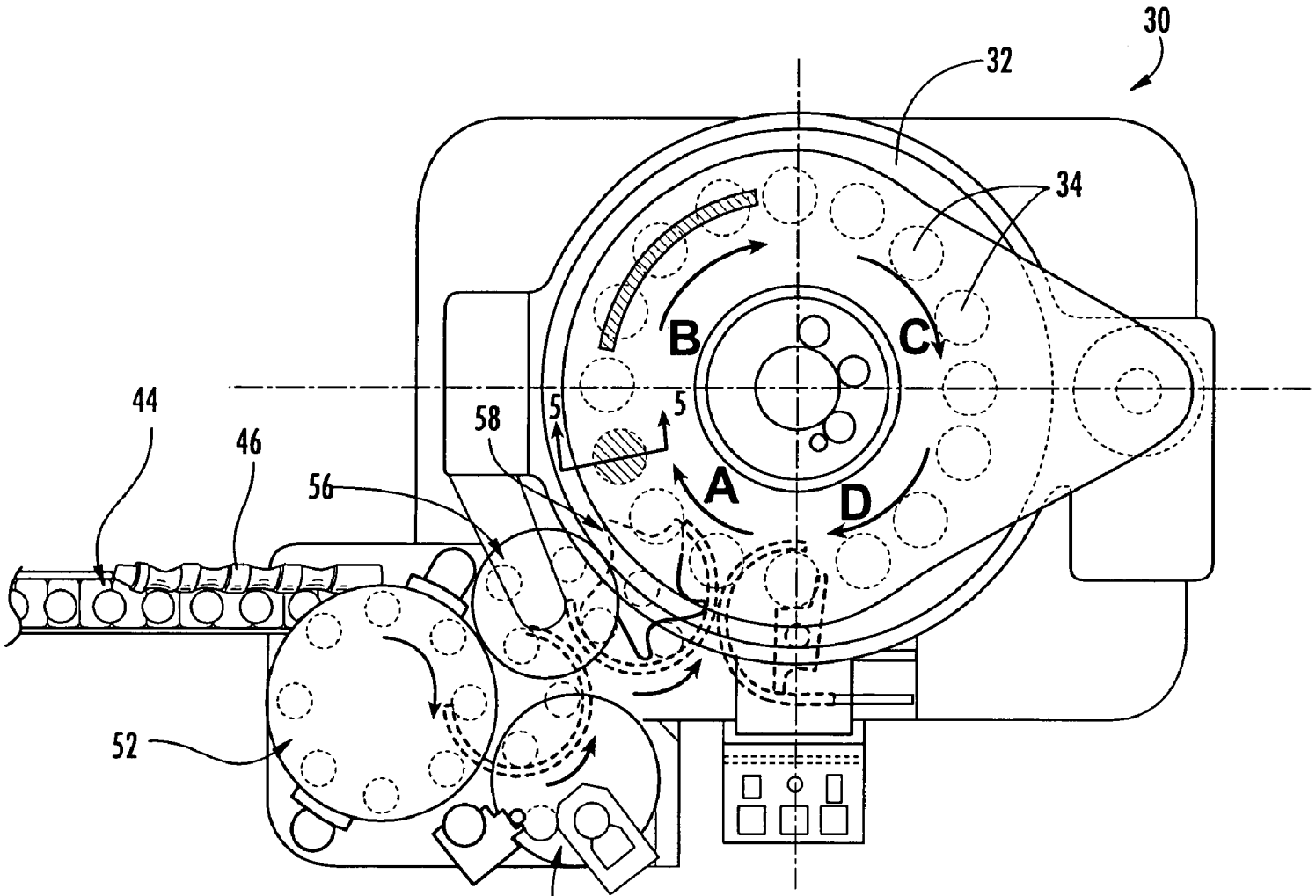
FIG. 4 is a top view, illustrating a composite can in sector A.
Figure 5:
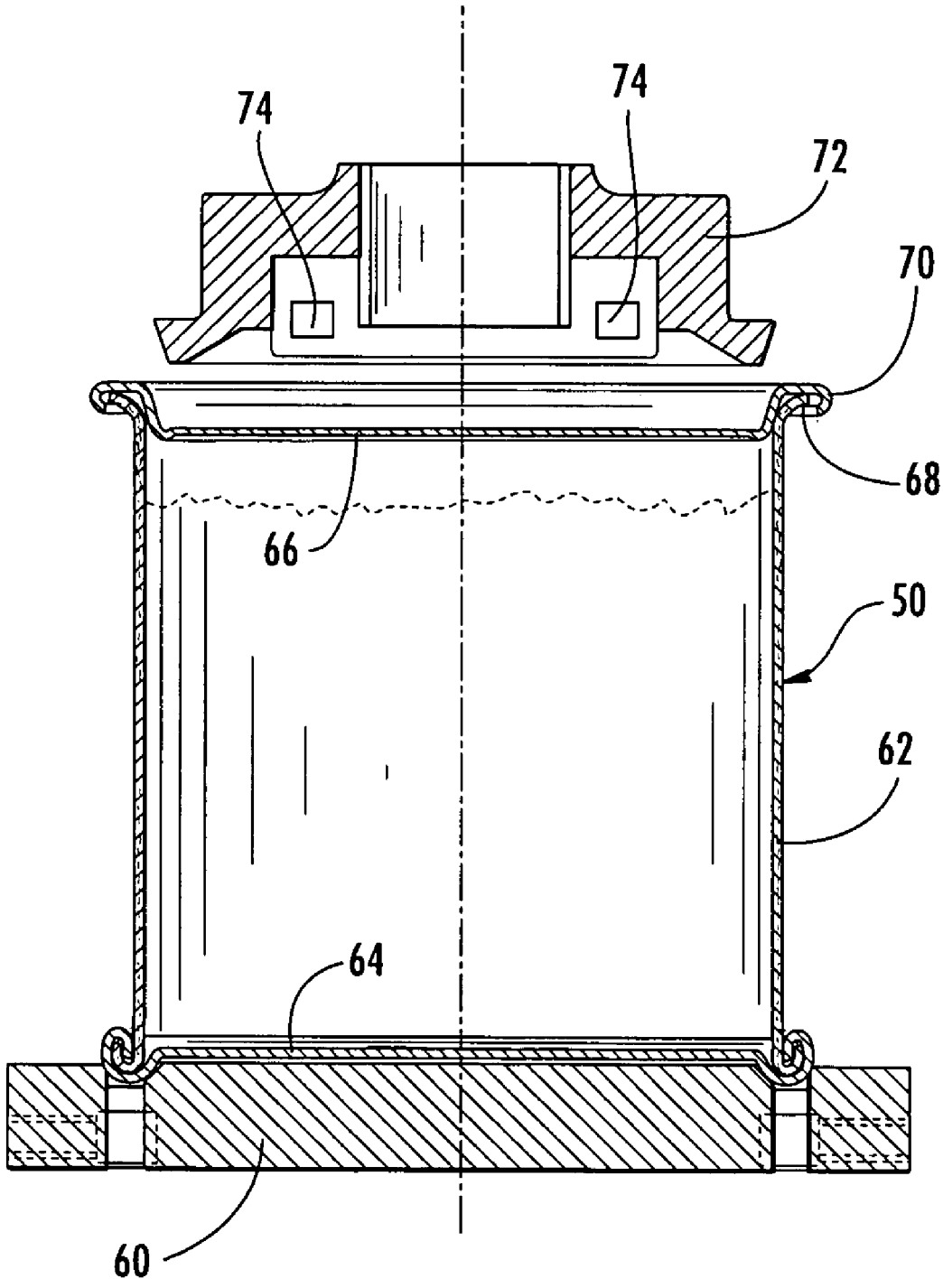
FIG. 5 is a cross-sectional view along line 5-5 of FIG. 4, showing the composite can supporting on the lifting plate of one of the chambers, with a metal end loosely placed atop the can.

In sector A of the machine, each chamber is opened by lowering the bellows-type lower portion 38 of the chamber so that a composite can may be advanced by the rotary feed device 58 laterally onto the lifting plate of the chamber. As the turntable 32 rotates about its axis, the composite can is then advanced along sector A toward sector B. FIG. 5 shows the composite can 50 supported on the lifting plate 60 of a chamber located in sector A as indicated in FIG. 4. The composite can comprises a composite can body 62 having a metal end 64 double-seamed onto the lower end of the can body, and a metal end 66 loosely placed atop the top edge of the can body. The top edge of the can body is curled outwardly to form a flange 68, and the metal end 66 includes an outer peripheral curled region 70 that receives the flange of the top edge. The metal end 66 is formed of a magnetically permeable material (e.g., a ferrous material such as steel).

Figure 23:
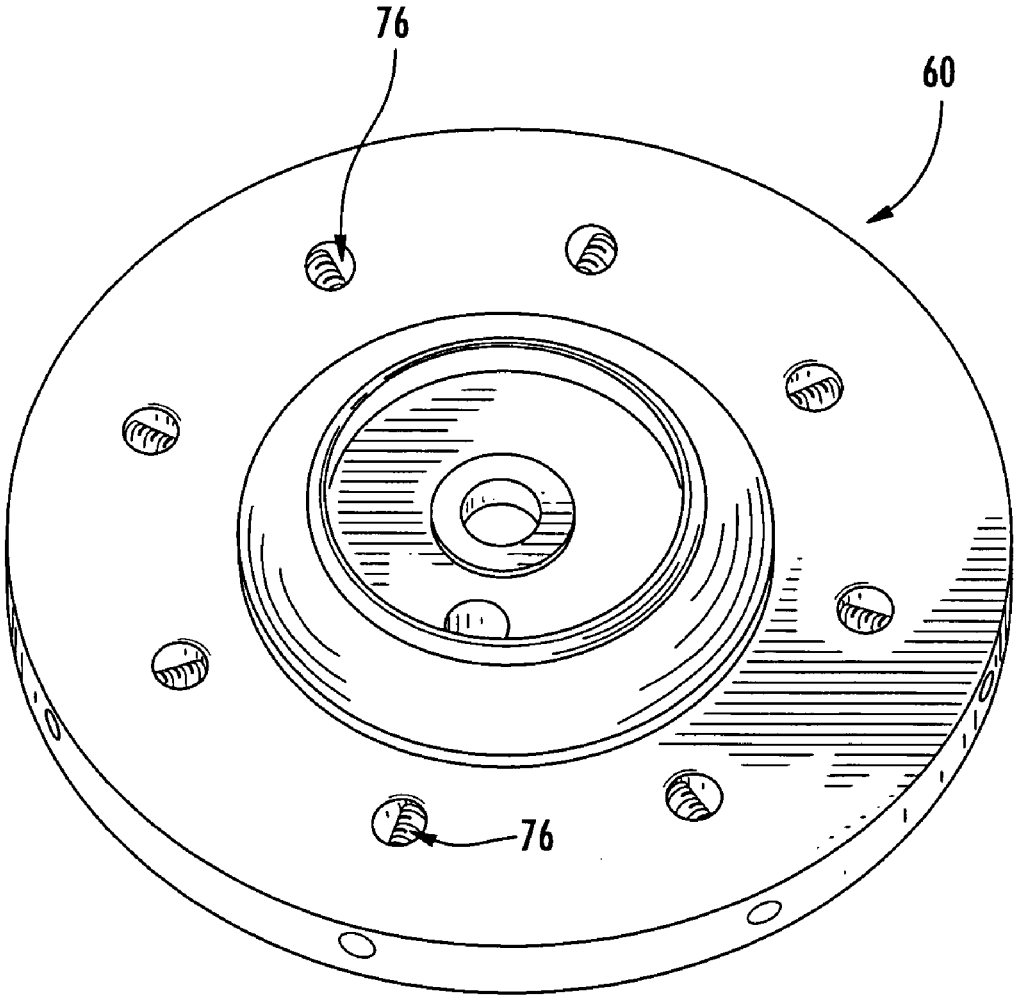
FIG. 23 is an isometric view of a magnetic lifting plate in accordance with one embodiment of the invention.

As shown in FIG. 5, the chamber includes a seaming chuck 72 for engaging the metal end 66 to provide support to the metal end during a seaming operation in which the curled region 70 of the metal end is rolled outwardly and curled under, along with the flange 68, to form a double seam securing the metal end to the can body. The double-seaming process per se is well known and hence is not described in great detail herein. The seaming chuck 72 includes at least one magnet 74 for attracting and magnetically holding the metal end 66 against the seaming chuck 72. As shown in FIG. 23, the seaming chuck in one embodiment includes a plurality of magnets 74 recessed in the seaming chuck and circumferentially spaced apart about a circle.

Figure 22:
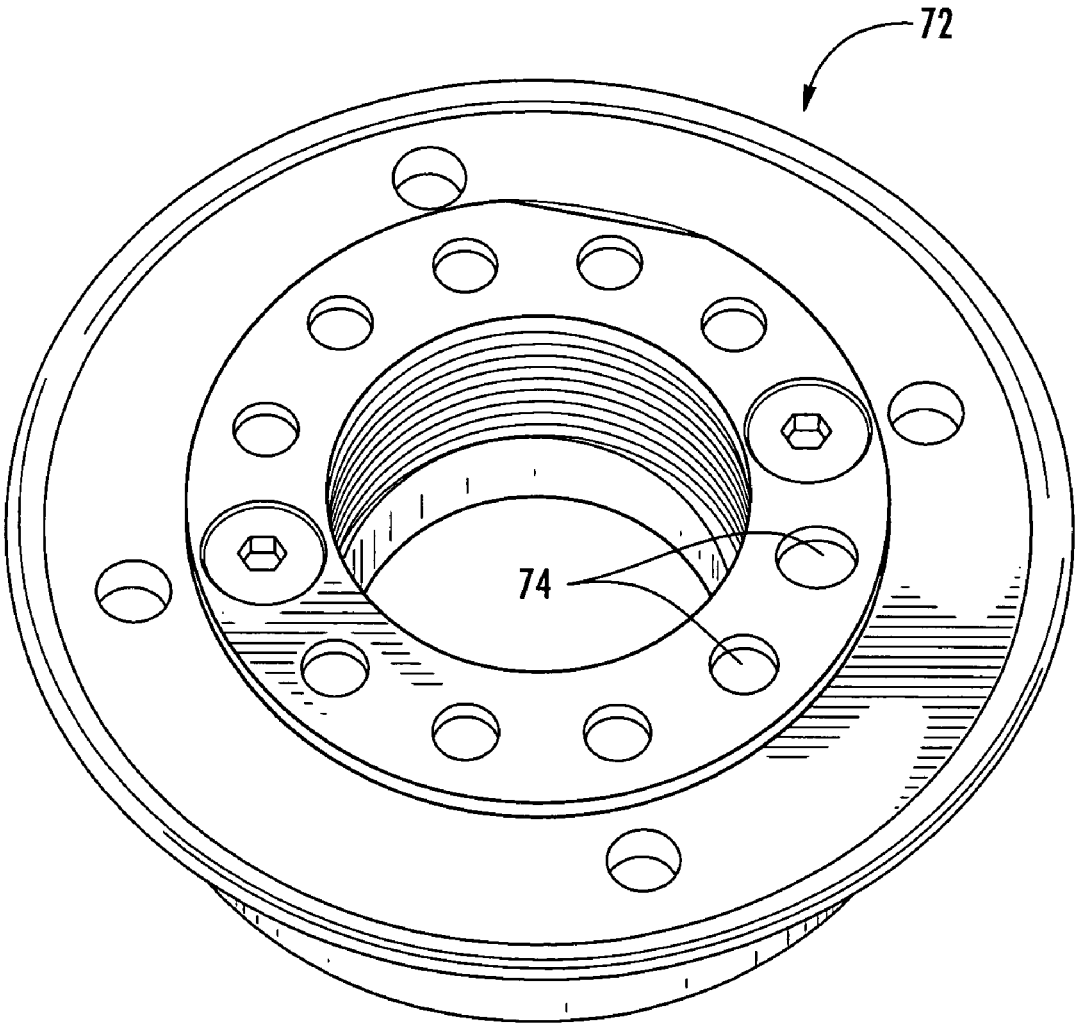
FIG. 22 is an isometric view of a magnetic seaming chuck in accordance with one embodiment of the invention.

The lifting plate 60 (shown in one embodiment in FIG. 22) can also comprise one or more magnets 76 for magnetically attracting and holding the bottom metal end 64 against the lifting plate. The magnets help to ensure that when the lifting plate is lowered, the composite can 50 also is lowered with it.

Figure 6:
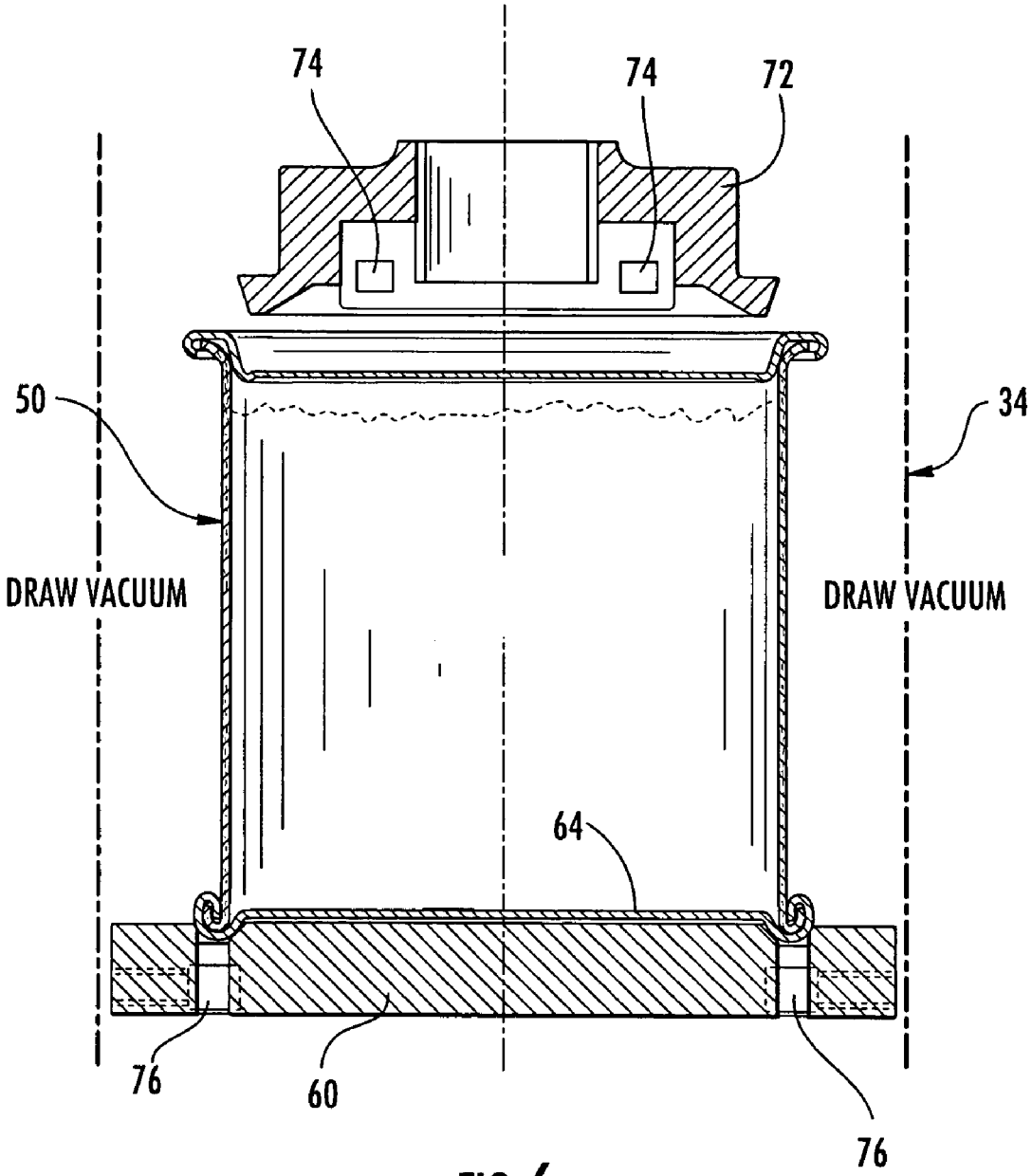
FIG. 6 is a view similar to FIG. 5, after the chamber has closed, with a vacuum having been drawn on the chamber.

At the point of sector A indicated in FIG. 4, and shown in cross-section in FIG. 5, the lifting plate 60 is in a relatively low position such that the metal end 66 is spaced below the magnetic seaming chuck 72. Next, as shown in FIG. 6, as the chamber is advanced further along sector A toward sector B, the chamber 34 (shown only diagrammatically in FIG. 6) is closed.

Figure 7:
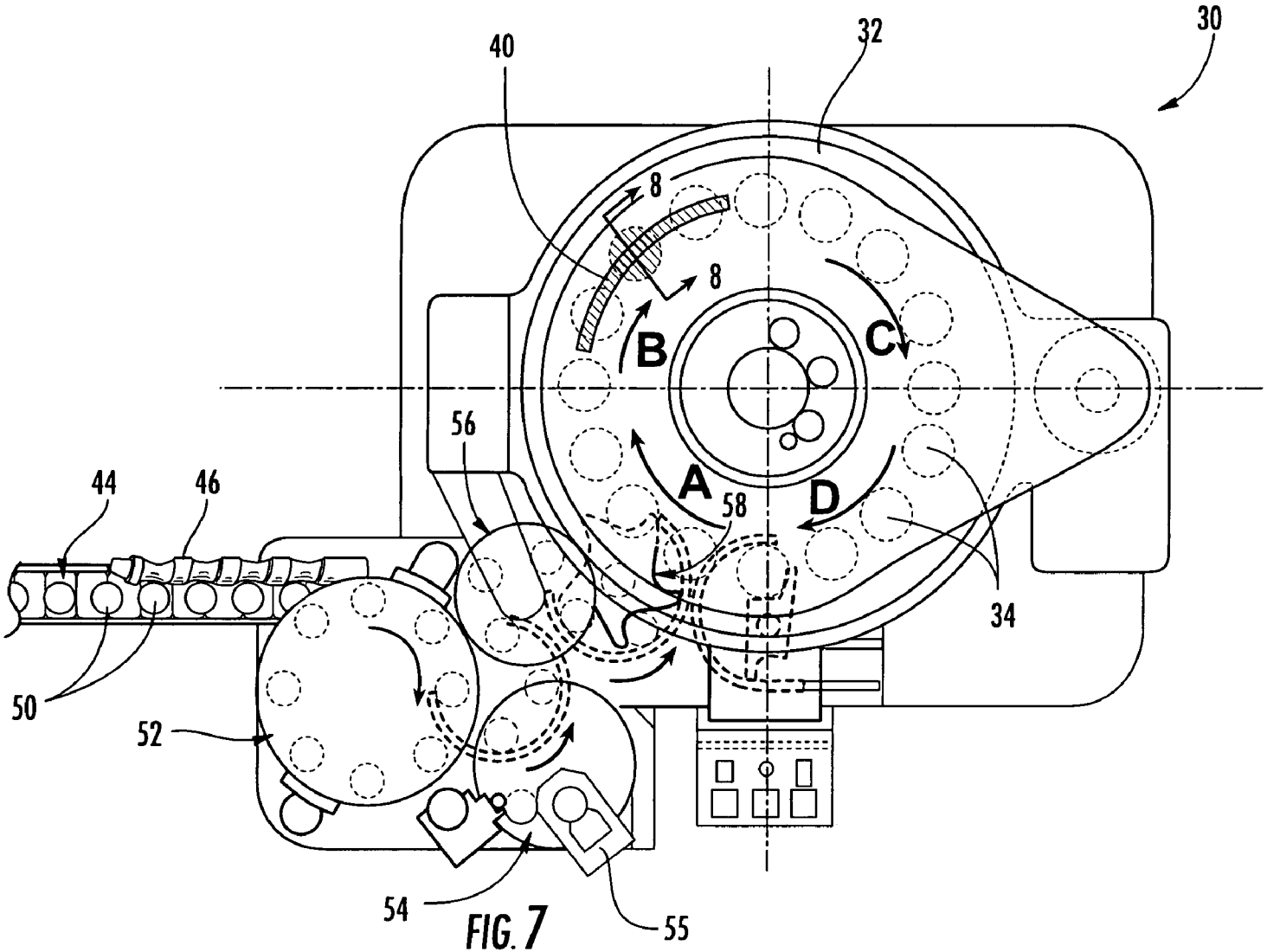
FIG. 7 is a top view showing the composite can having progressed to sector B of the seaming machine.
Figure 8:
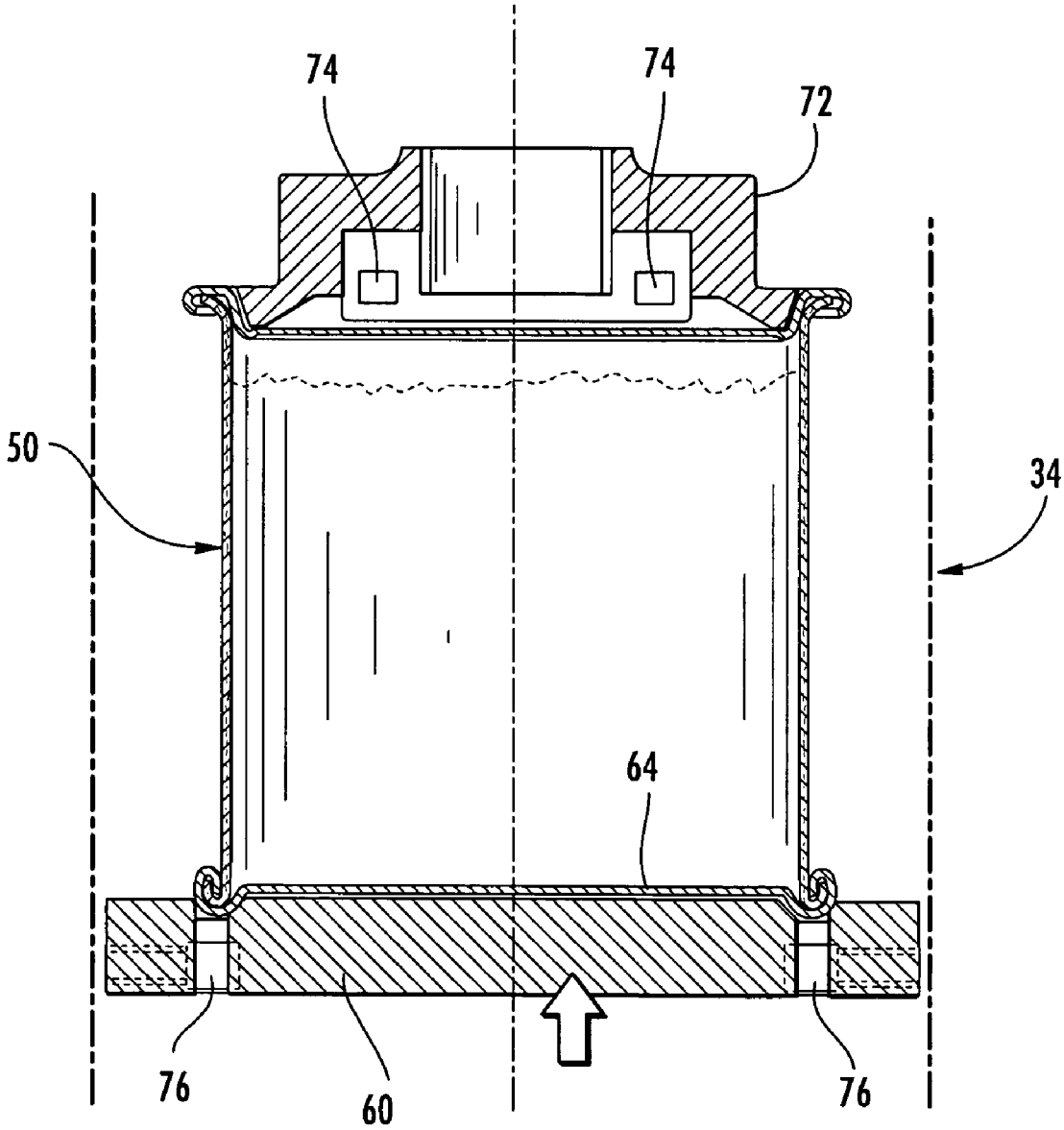
FIG. 8 is a cross-sectional view along line 8-8 of FIG. 7, wherein the lifting plate has lifted the composite can so that the metal end is engaged by the magnetic seaming chuck associated with the chamber.

FIGS. 7 and 8 depict a next stage of the seaming operation that takes place in sector B. As dictated by the profile of the cam, the lifting plate 60 is raised to cause the metal end 66 to engage the magnetic seaming chuck 72. The magnets 74 attract and hold the metal end against the seaming chuck. FIG. 7 shows a cam portion 40 that provides the necessary cam profile to cause the lifting plate 60 to be raised to bring the metal end 66 into engagement with the magnetic seaming chuck 72. The cam portion 40 can comprise an integral part of a one-piece cam. Alternatively, the cam portion 40 can comprise a member formed separately from the main cam and affixed in releasable fashion to the main cam. Thus, for example, the main cam can have a profile suitable for a seaming operation that does not require an extra lift of the container (e.g., as in the case of a metal can), and the additional cam portion 40 can be added to the main cam when it is desired to use the machine for seaming composite cans that require the extra lift.

Figure 9:
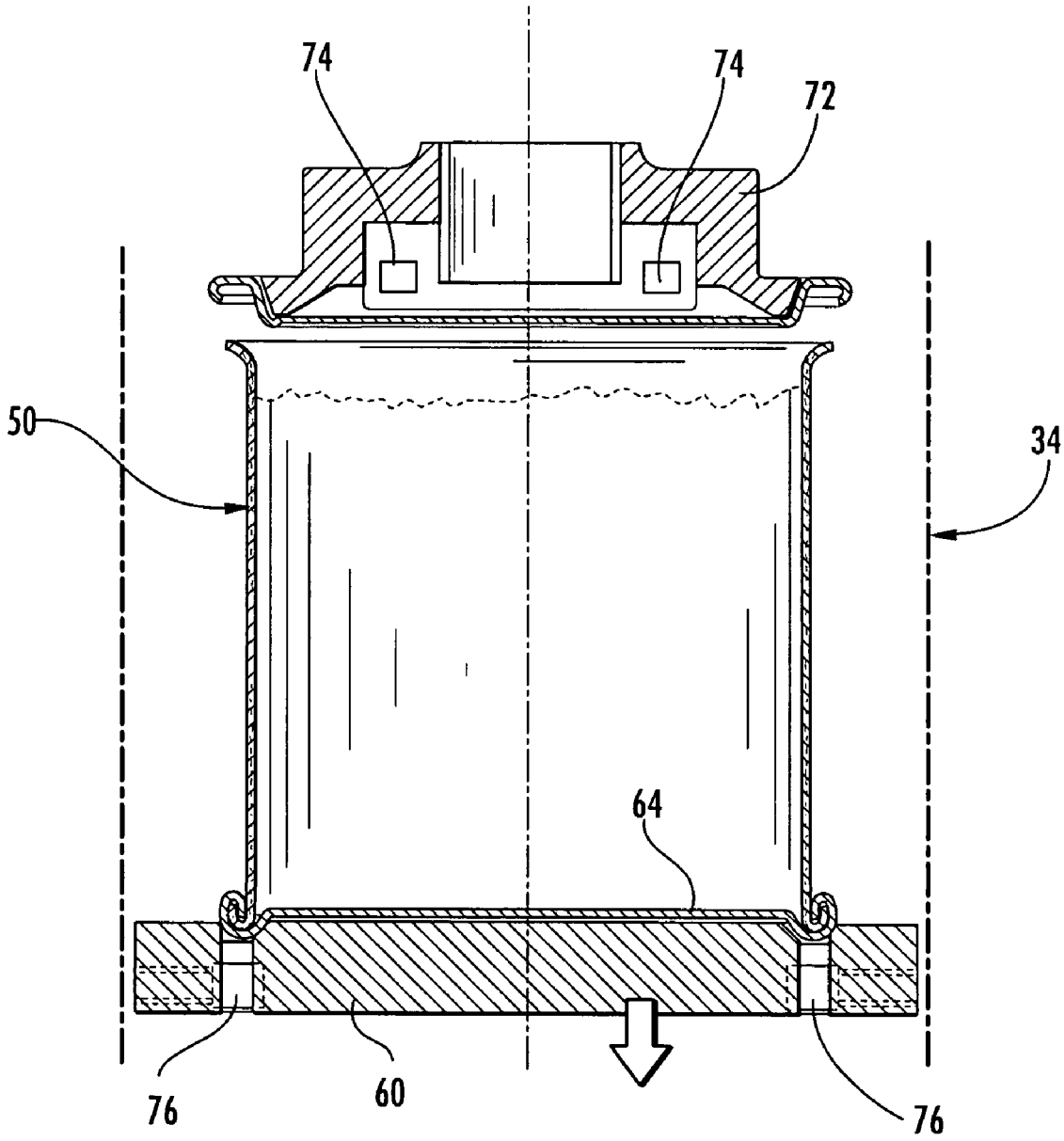
FIG. 9 is a view similar to FIG. 8, at a later instant in time after further rotation of the turntable, wherein the lifting plate has been lowered to lower the composite can, thereby creating a gap between the top edge of the can and the metal end.
Figure 10:
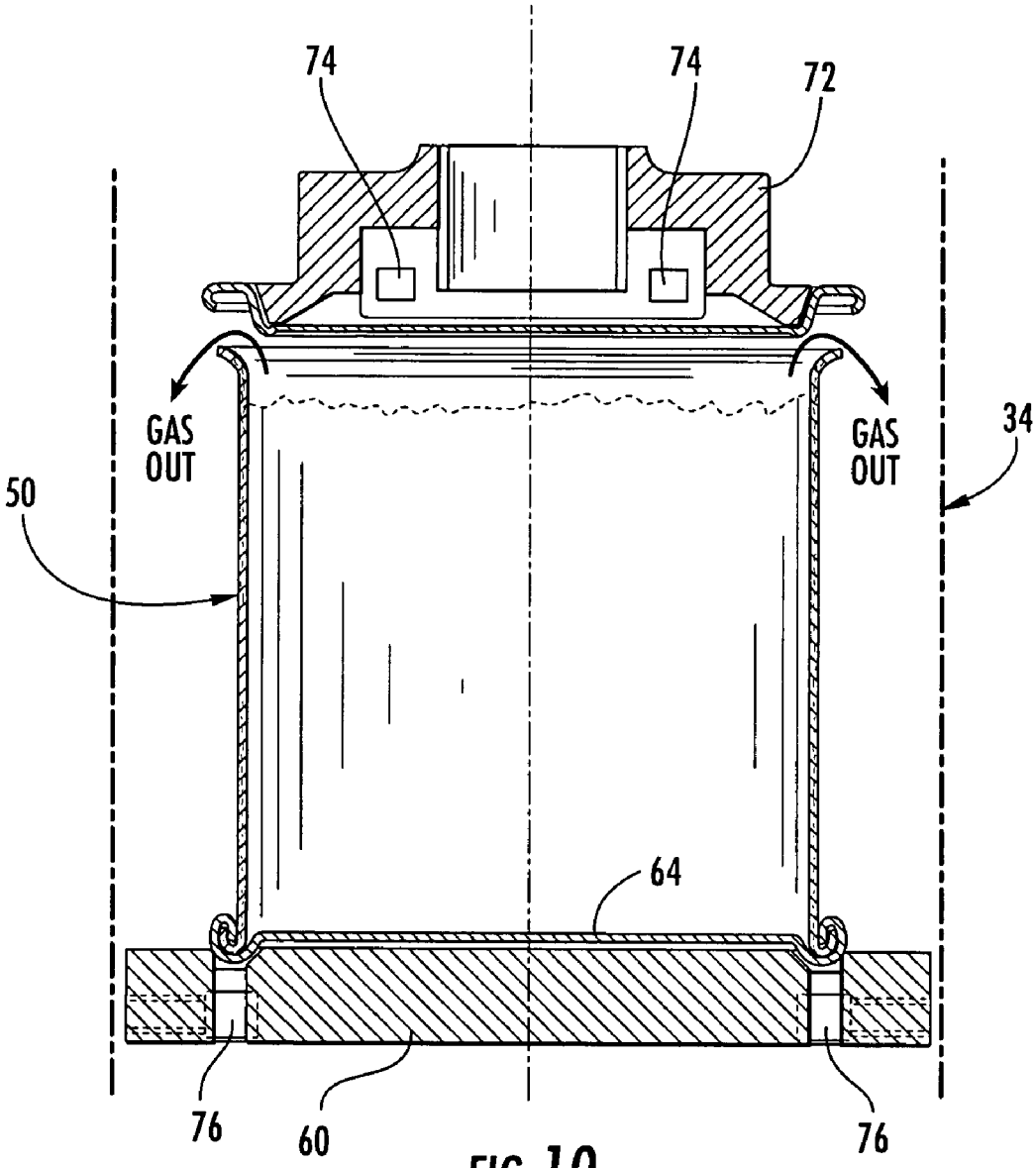
FIG. 10 shows the composite can being evacuated through the gap as a result of the vacuum in the chamber.
Figure 11:
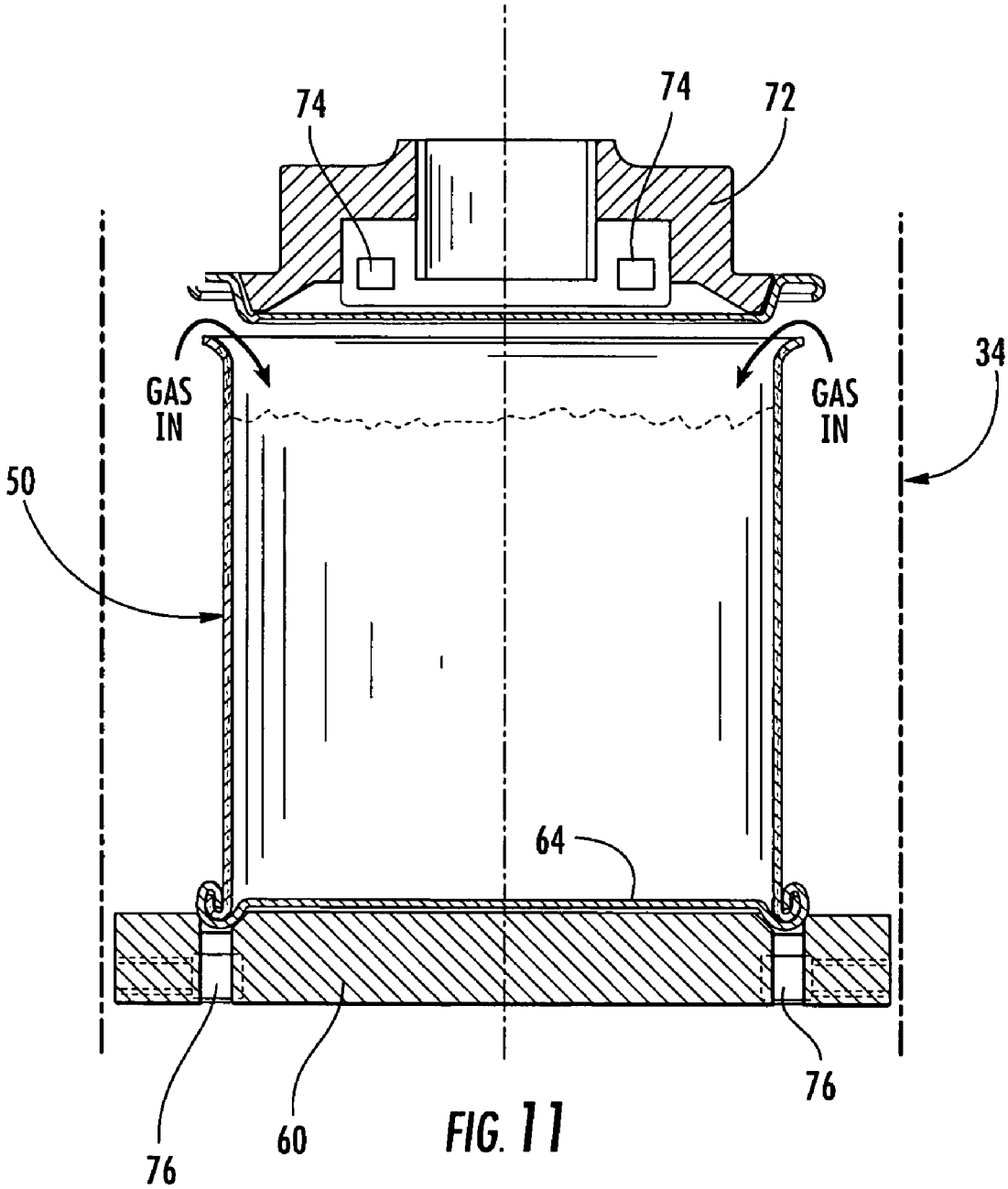
FIG. 11 is a view similar to FIG. 10, at a later instant in time at which the chamber is filled with an inert gas, the insert gas flowing into the composite can through the gap between the can and the metal end.

Next, as depicted in FIG. 9, the lifting plate 60 is lowered, as dictated by the cam profile, to cause the can body 62 and bottom metal end 64 to be lowered away from the top metal end 66 that is held on the magnetic seaming chuck 72. The magnets 76 in the lifting plate 60 help ensure that the can is lowered along with the lifting plate. A gap 78 is thereby created between the flange 68 of the can body and the metal end 66. Before, concurrently with, or after the step of raising the composite can as shown in FIG. 8, a vacuum is drawn on the chamber 34 to evacuate air. As a result of the vacuum drawn on the chamber 34, air inside the can body 62 exits through the gap 78 as shown in FIG. 10. After the can body has been evacuated, the chamber 34 is then fed an inert gas such as nitrogen, which causes the inert gas to flow into the can through the gap 78 as shown in FIG. 11.

Figure 12:
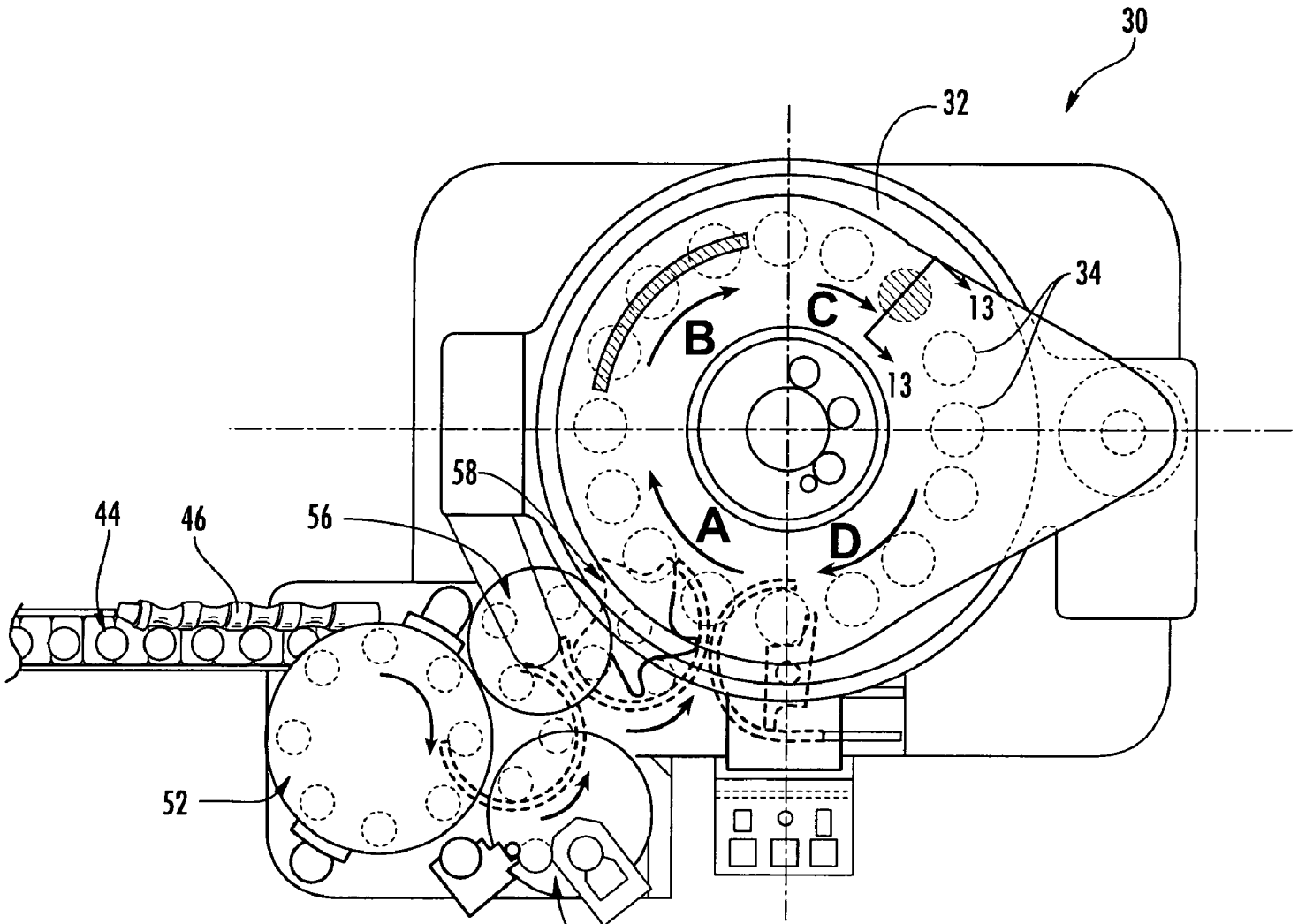
FIG. 12 is a top view of the seaming machine, showing the composite can having progressed to sector C.
Figure 13:
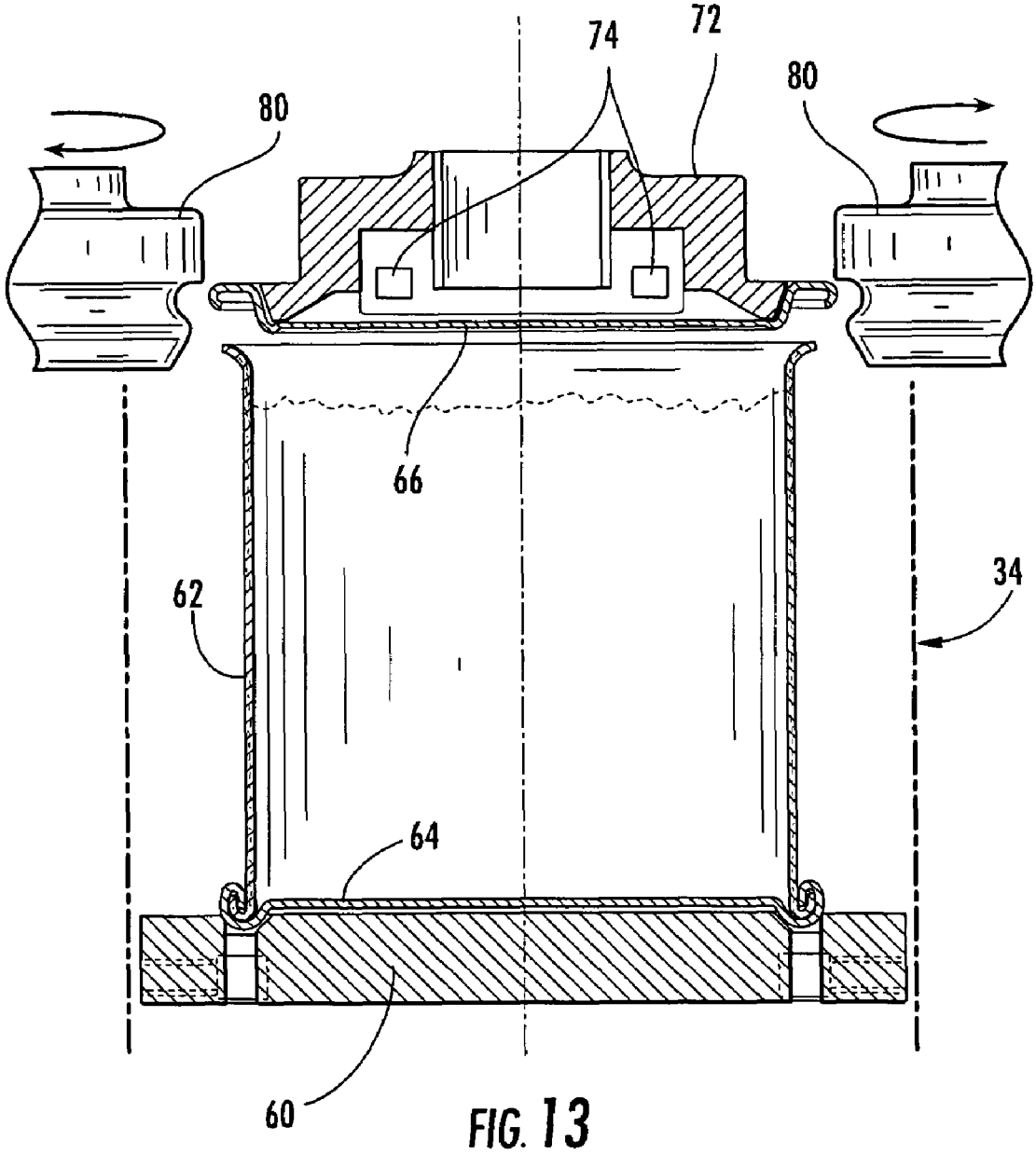
FIG. 13 is a cross-sectional view along line 13-13 of FIG. 12, showing the seaming rollers being moved into position to engage the metal end.
Figure 14:
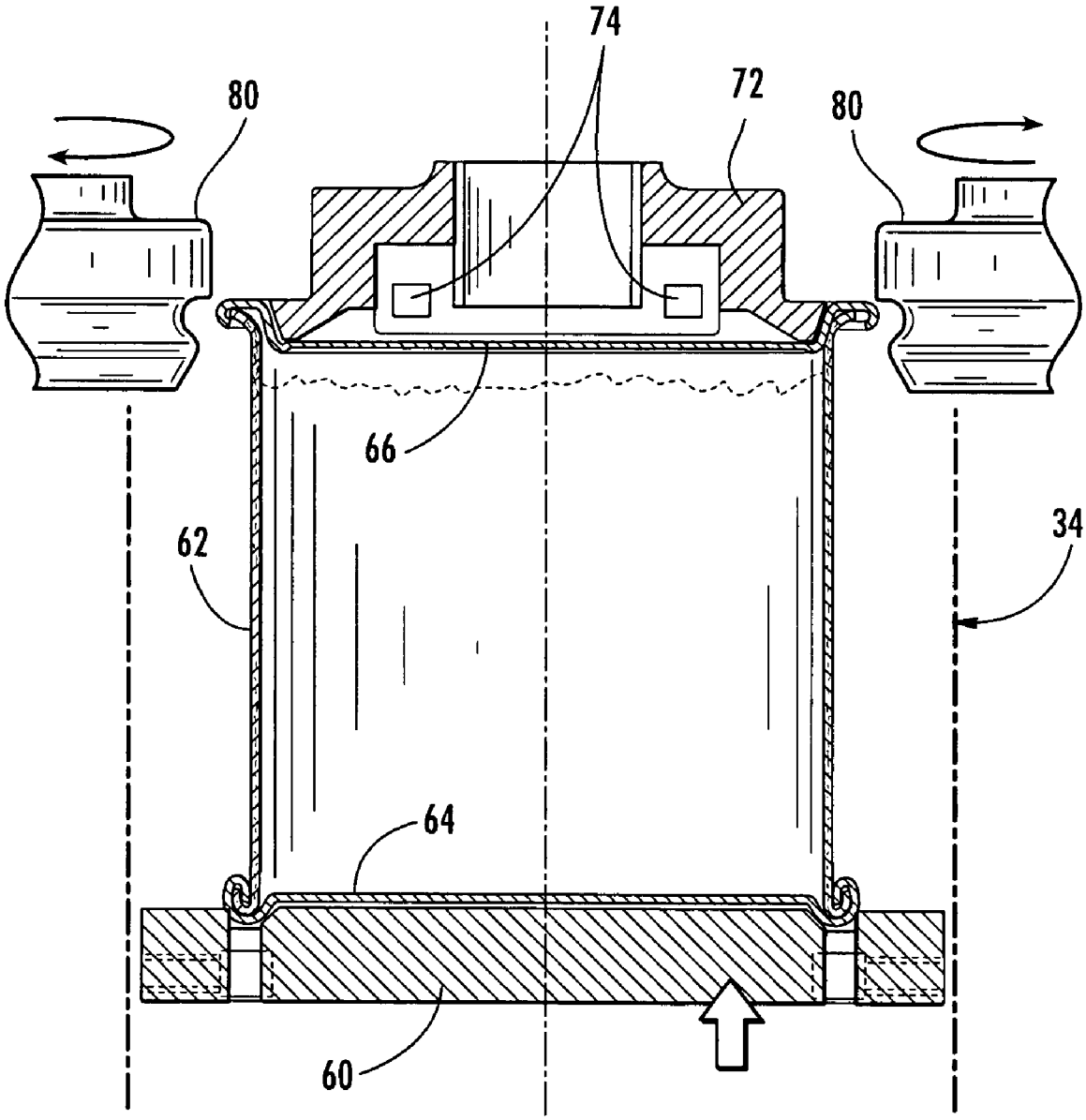
FIG. 14 is a view similar to FIG. 13, at a later instant in time at which the lifting plate has been raised to lift the can into engagement with the metal end held by the magnetic seaming chuck.

FIGS. 12 through 14 depict the next stage of the seaming operation that takes place in sector C. As depicted in FIG. 14, the lifting plate 60 is raised to bring the flange 68 of the can body into engagement with the curled region 70 of the metal end 66 in preparation for seaming the metal end onto the can body.

Figure 15:
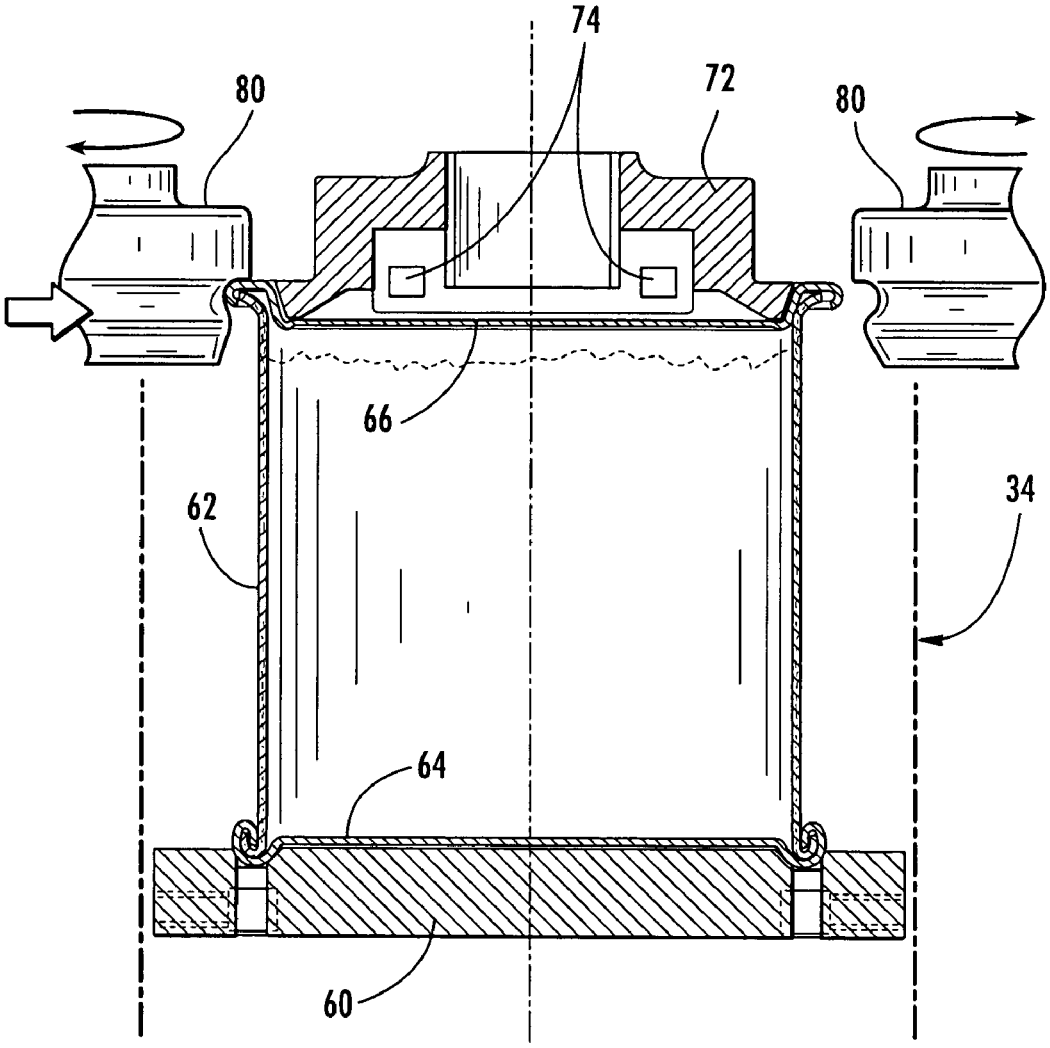
FIG. 15 shows the metal end engaged by a first one of the seaming rollers to partially roll the metal end and flange of the can under.
Figure 16:
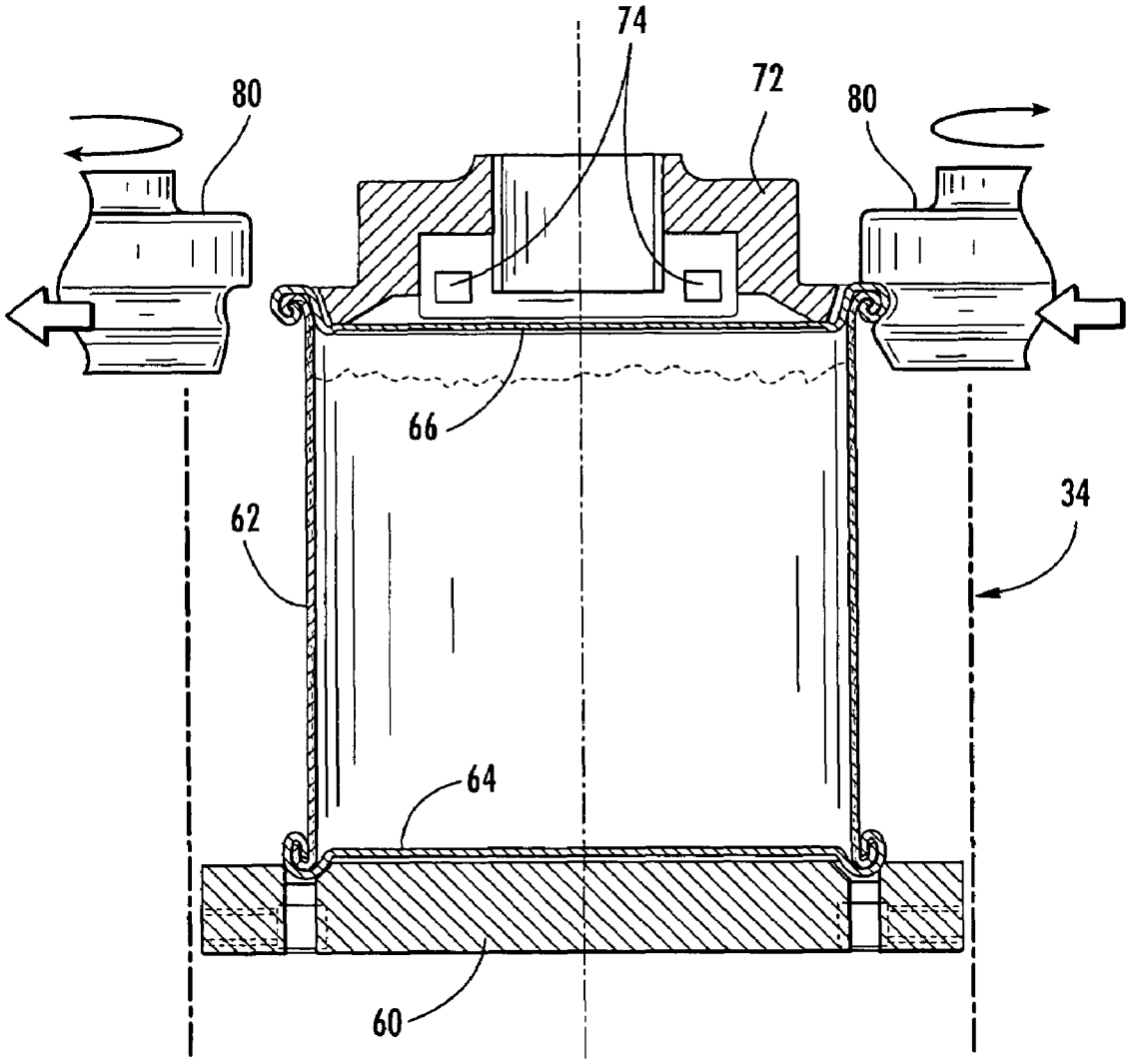
FIG. 16 shows the metal end engaged by the second seaming roller to complete the formation of a double seam attaching the metal end to the composite can.
Figure 17:
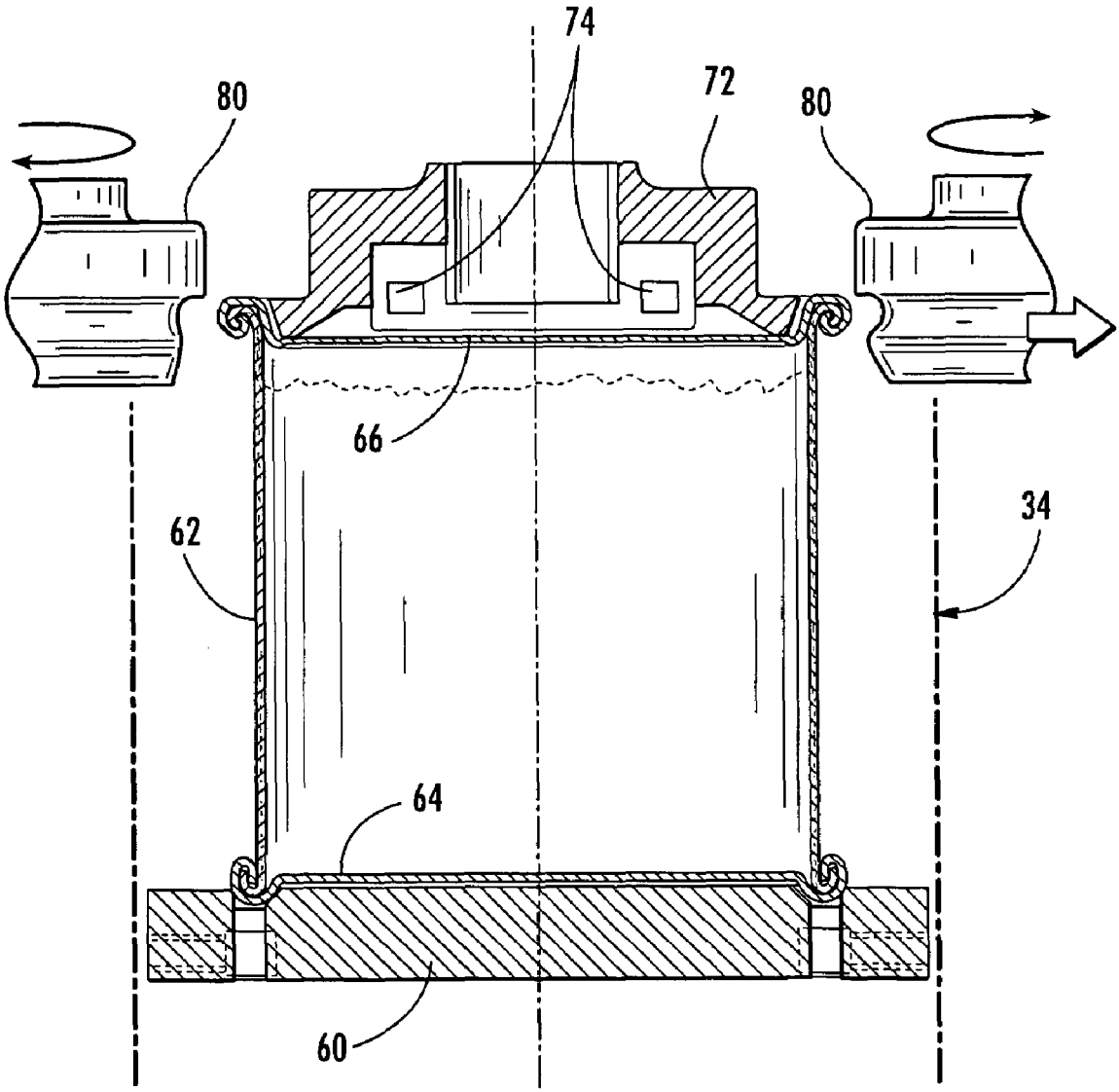
FIG. 17 shows the seaming rollers moved back away from the metal end.

A pair of seaming rollers 80 are disposed on diametrically opposite sides of the seaming chuck 72 for each chamber. The seaming rollers 80 are laterally movable toward and away from the seaming chuck 72. As shown in FIG. 15, to begin the seaming process, a first one of the seaming rollers 80 is moved toward the seaming chuck 72 so that the curled region 70 of the metal end is pressed by the roller radially inwardly against the seaming chuck. The seaming roller is rotated about its axis while being urged radially inwardly to press the curled region 70 against the seaming chuck 72, thereby causing the metal end 66 and can body 62 to be rotated about the can's axis and causing the curled region 70 and the flange 68 of the can body to be rolled partway under. Next, the first seaming roller 80 is moved away from the seaming chuck 72 and the other seaming roller 80, which has a different groove profile from the first roller, is moved into engagement with the partially rolled-under curled region 70 as in FIG. 16. The second seaming roller is rotated about its axis while being urged radially inwardly to press the curled region 70 against the seaming chuck 72, thereby causing the metal end 66 and can body 62 to be rotated about the can's axis and causing the curled region 70 and the flange 68 of the can body to be further rolled under to form a completed double seam. The second seaming roller 80 is then moved back away from the can as in FIG. 17.

Figure 18:
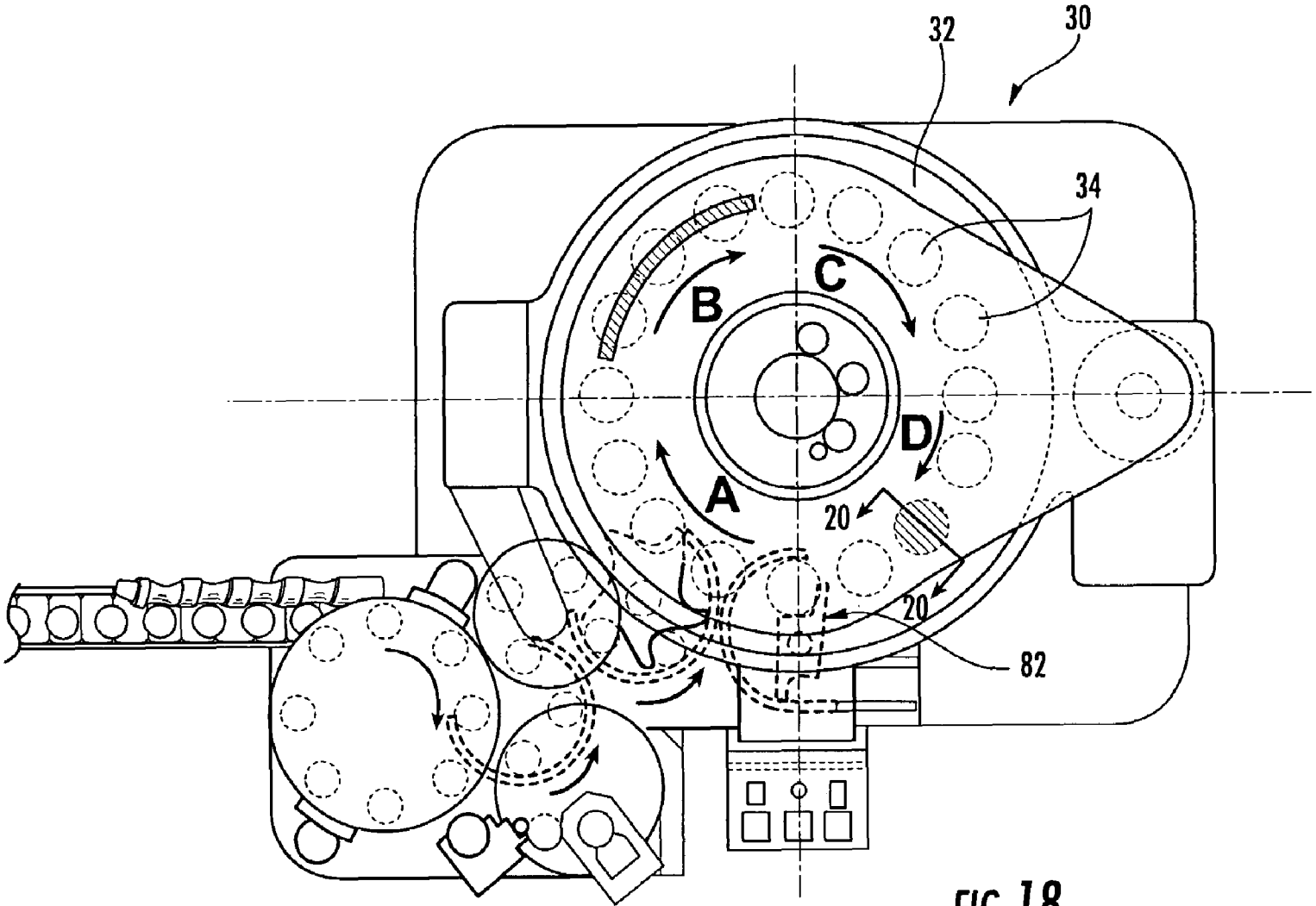
FIG. 18 is a top view of the seaming machine, showing the composite can having progressed to sector D, with the sealed composite can within the closed chamber.
Figure 19:
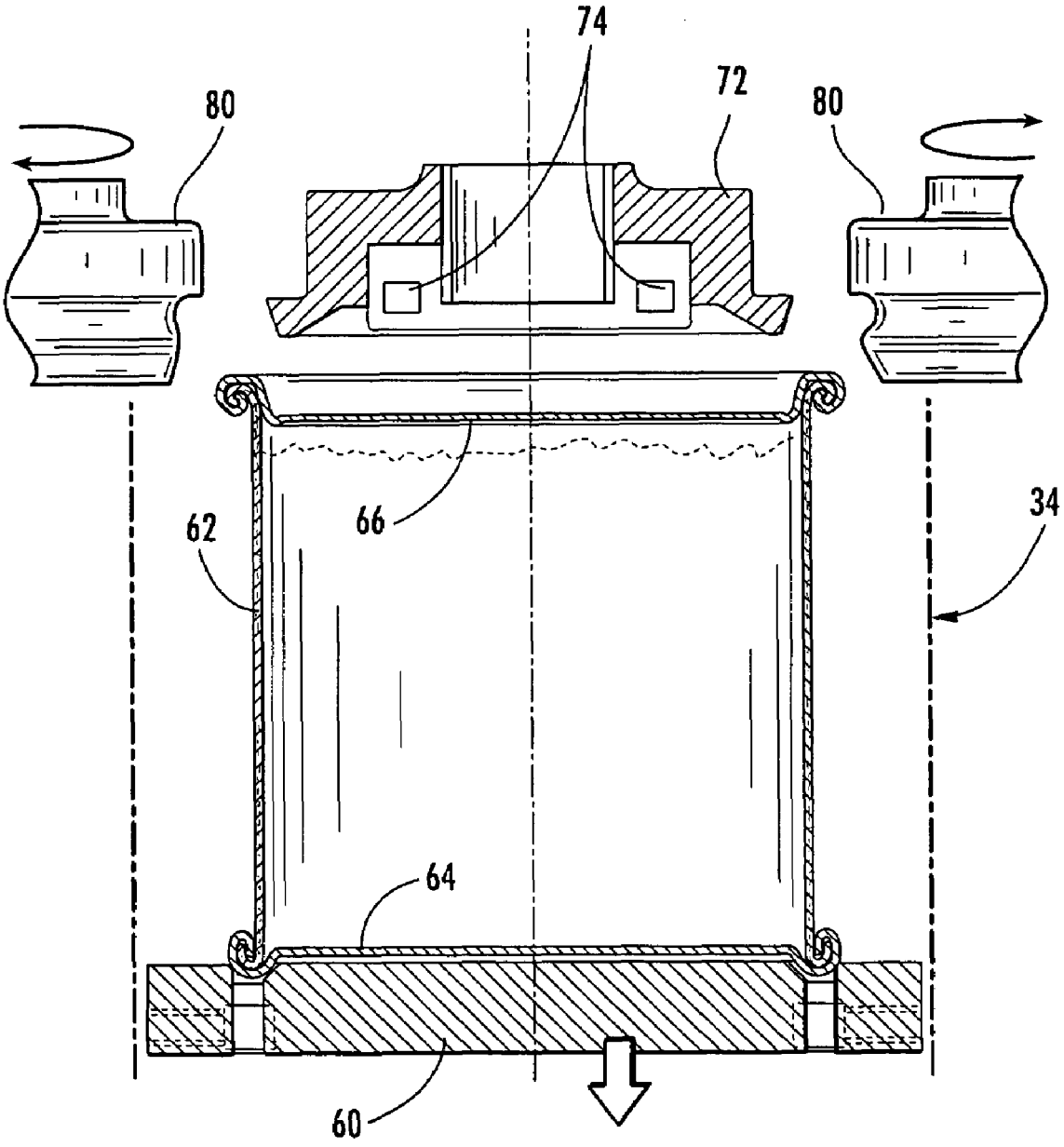
FIG. 19 shows the composite can being lowered by the lifting plate.
Figure 20:
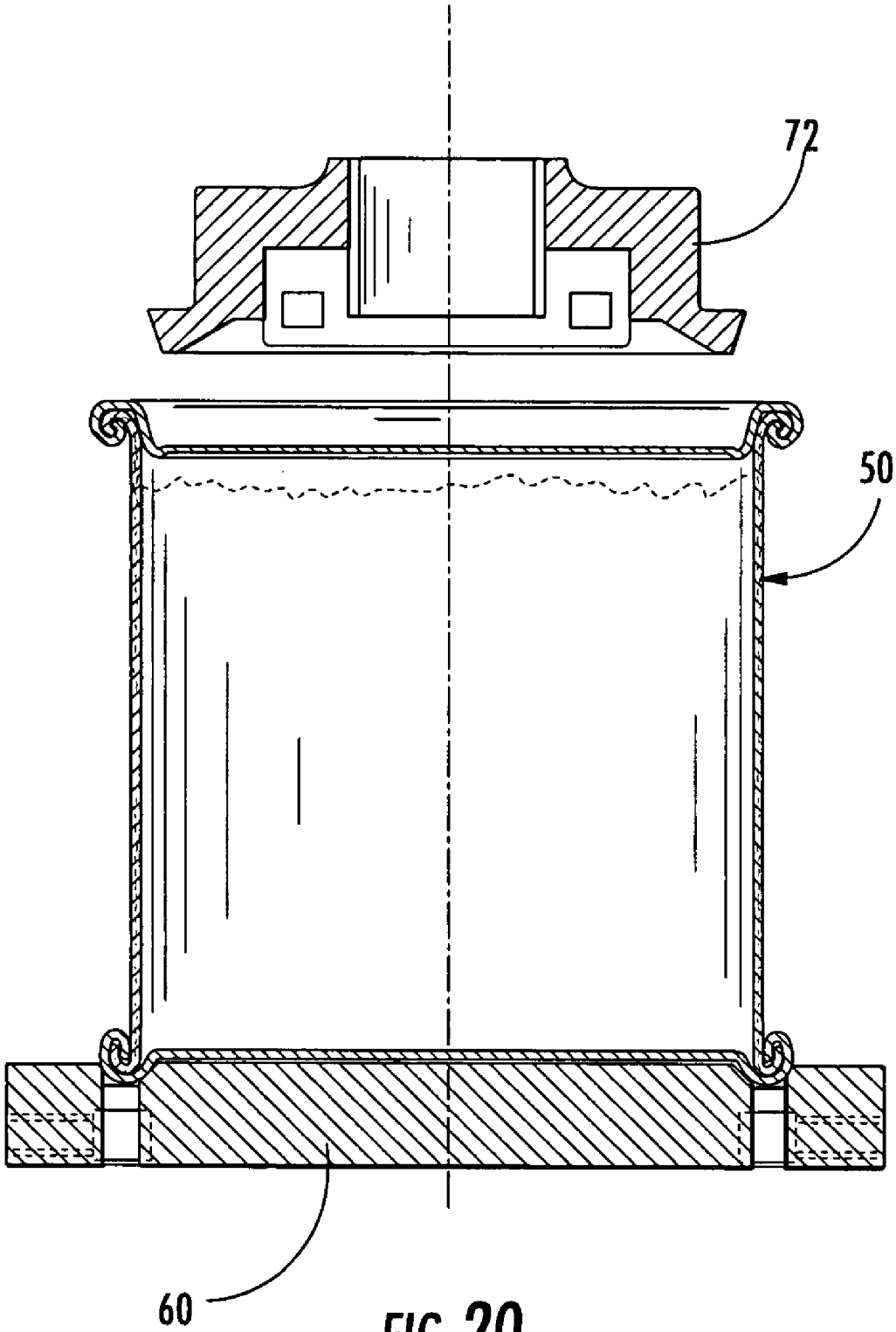
FIG. 20 shows the chamber having been opened to release the inert gas and prepare the composite can to be discharged from the chamber.

The turntable continues to be rotated into sector D as shown in FIG. 18. FIG. 19 shows that in sector D, the lifting plate 60 is lowered to lower the sealed composite can 50. The magnetic seaming chuck 72 allows the can 50 to fall because the weight of the can and its contents exceeds the magnetic attraction force of the magnets 74.

At this point, the composite can 50 is sealed and ready to be discharged from the chamber 34. Thus, as shown in FIG.

Figure 21:
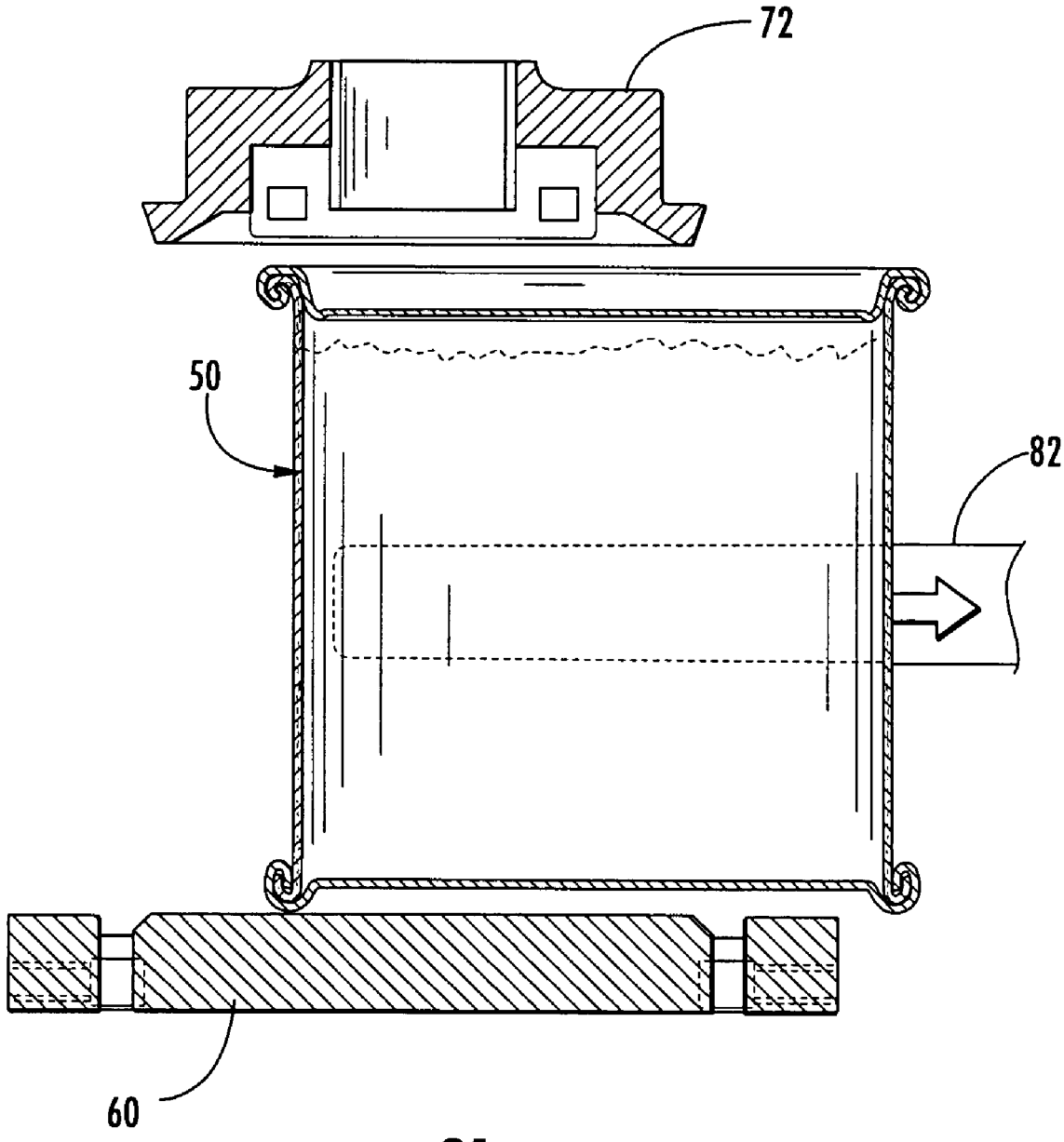
FIG. 21 shows the can being discharged from the chamber.

20, the chamber 34 is opened, and finally the can is discharged from the chamber by a discharge device 82 as shown in FIG. 21.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A seaming machine for seaming metal ends onto composite cans, the seaming machine comprising:

a rotary turntable supporting a plurality of chambers spaced about a circumference of the turntable, each chamber being structured and arranged to enclose an upright composite can with a metal end loosely placed on a top edge of the composite can, each chamber having a bottom comprising a lifting plate that supports the composite can and that is structured and arranged to be raised and lowered;

a seaming chuck disposed above each of the chambers for engaging a metal end placed atop a composite can in the chamber;

a pair of seaming rollers disposed above each of the chambers for seaming a metal end onto a composite can in the chamber;

a cam mounted beneath the turntable and engaging lifters respectively connected to the lifting plates, the cam defining a cam profile such that as the turntable is rotated about an axis thereof, the lifter for a given chamber is moved vertically according to the cam profile to cause the lifting plate to rise and fall, thereby lifting and lowering the composite can relative to the seaming chuck for the chamber;

wherein each seaming chuck comprises a magnet for magnetically attracting and holding onto a metal end atop a composite can in the respective chamber such that the metal end is prevented from falling when the composite can is lowered; and wherein the cam profile is configured to cause each lifting plate to be raised to bring a metal end atop a composite can supported on the lifting plate into engagement with the seaming chuck so that the metal end is held by the magnet, and then to be lowered so as to lower the composite can and thereby create a gap between the composite can and the metal end held on the magnetic seaming chuck, so that gas transfer can take place into and out of the composite can through the gap, and wherein each lifting plate further comprises a magnet for attracting and holding onto a metal end affixed to a bottom end of a composite can supported on the lifting plate.

2. An apparatus for use in a seaming process for seaming a metal end onto a composite can having a bottom metal end affixed to a bottom end of the can, comprising:

a chamber for containing a composite can with a metal end loosely placed atop the can, a bottom of the chamber comprising a lifting plate that supports the composite can, the lifting plate being vertically movable and comprising at least one magnet for attracting and holding onto the bottom metal end of the composite can; and a seaming chuck located above an upper end of the chamber, the seaming chuck comprising at least one magnet for attracting and holding onto a metal end on a composite can in the chamber such that the metal end is prevented from falling when the lifting plate is lowered to cause the composite can to be lowered.

3. The apparatus of claim 2, wherein the lifting plate comprises a plurality of magnets spaced apart.

4. The apparatus of claim 2, wherein the seaming chuck comprises a plurality of magnets spaced apart.

5. A method for seaming a metal end onto a composite can, the method comprising the steps of:

disposing a composite can in a chamber with a metal end loosely placed atop an upper edge of the can, and with the composite can supported on a vertically movable lifting plate;

providing a seaming chuck disposed above the chamber, the seaming chuck comprising at least one magnet for attracting and holding onto the metal end on the composite can such that the metal end is prevented from falling when the lifting plate is lowered to cause the composite can to be lowered;

evacuating air from the chamber;

raising the lifting plate in the chamber to raise the composite can and cause the metal end to engage the seaming chuck such that the at least one magnet holds onto the metal end;

lowering the lifting plate to lower the composite can and thereby create a gap between the upper edge of the can and the metal end held on the seaming chuck;

introducing an inert gas into the chamber such that the inert gas enters the composite can through the gap;

raising the lifting plate to engage the top edge of the inert gas-filled composite can with the metal end held on the seaming chuck; and seaming the metal end onto the composite can.

6. The method of claim 5, further comprising the step of providing at least one magnet in the lifting plate for attracting and holding onto a metal end affixed to a bottom end of the composite can.

7. The method of claim 5, wherein the evacuating step occurs before the first raising step.

8. The method of claim 5, wherein the evacuating step occurs concurrently with the first raising step.

9. The method of claim 5, wherein the evacuating step occurs after the first raising step.

* * * * *